US005624330A

United States Patent [19]

Tsuchida

[11] Patent Number: 5,624,330

[45] Date of Patent: Apr. 29, 1997

[54] JOINT STRUCTURE FOR A GOLF CLUB

[75] Inventor: Atsushi Tsuchida, Shizuoka-ken, Japan

[73] Assignee: Yamaha Corporation, Japan

[21] Appl. No.: 546,307

[22] Filed: Oct. 20, 1995

[30] Foreign Application Priority Data

Oct. 26, 1994 [JP] Japan ..... 6-284510

[51] Int. Cl.[6] ..... A63B 53/02

[52] U.S. Cl. ..... 473/308; 473/310

[58] Field of Search ..... 273/80.1, 80.2, 273/80.3, 80.4, 80.5, 80.6, 80.7, 80.8, 80.9, 80 R, 79, 167 R, 77 R; 473/305, 306, 307, 308, 309, 310, 311, 312, 313, 314, 315

[56] References Cited

U.S. PATENT DOCUMENTS

| | | | |
|---|---|---|---|
| 1,480,056 | 1/1924 | Flint | 273/80.9 |
| 1,643,754 | 9/1927 | Sleith | 273/80.3 |
| 1,644,510 | 10/1927 | Buhrke | 273/80.3 |
| 1,940,168 | 12/1933 | Hillerich | 273/806 |
| 1,983,069 | 12/1934 | Cowdery | 273/80.3 |
| 2,458,920 | 1/1949 | Wheeler | 273/80.7 |
| 3,572,709 | 3/1971 | Risher | 273/80.2 |
| 4,948,132 | 8/1990 | Wharton | 273/80.2 |
| 5,335,909 | 8/1994 | Green | 273/80.8 |

FOREIGN PATENT DOCUMENTS 6454574 4/1989 Japan .

*Primary Examiner*—Sebastiano Passaniti

*Attorney, Agent, or Firm*—Ostrolenk, Faber, Gerb & Soffen, LLP

[57] ABSTRACT

In construction of a joint structure between a hosel, a shaft and a ferrule, a rugged engagement is formed between the hosel and the ferrule in order to withstand a force at shooting balls which tends to move the ferrule apart from the hosel. The rugged engagement consists of at least one projection formed on one of the ferrule and the hosel and a recess formed in the other of the ferrule and the hosel.

6 Claims, 3 Drawing Sheets

JOINT STRUCTURE FOR A GOLF CLUB

BACKGROUND OF THE INVENTION

The present invention relates to a joint structure for a golf club, and more particularly relates to improvement in joint strength between a hosel and a shaft of a golf club.

In a conventional construction of a metallic golf club, a shaft made of FRP is inserted into and bonded to a hosel of the golf club. In order to enhance the joint strength between the shaft and the hosel, use of a reinforcement called "ferrule" has already been proposed in, for example, Japanese Utility Model Opening Sho. 64-54574.

Such a ferrule is a monolithic element made up of a conical sleeve section and a cylindrical barrel section and a cylindrical hole is formed longitudinally through the two sections. The cylindrical hole is adapted for accommodating a shaft.

In assemblage of a golf club, the cylindrical barrel section of the ferrule is first inserted into an enlarged upper end section of a shaft hole formed in the hosel and a tip of the shaft is inserted into the shaft hole past the cylindrical hole in the ferrule. By application of bonding agent, the tip of the shaft is fixed to the ferrule and the hosel by assistance of an intermediate bond layer. Presence of the cylindrical barrel section in the joint region well mitigates stress concentration on the mating plane between the ferrule and the hosel at shooting balls.

With this construction of the conventional ferrule, however, a relatively smooth surface of the barrel section tends to allow accidental separation of the ferrule from the hosel when impulsive stress at shooting balls acts on the joint structure repeatedly.

SUMMARY OF THE INVENTION

It is thus the primary object of the present invention to enhance the joint strength between a shaft and a hosel of a golf club in order to prevent accidental separation of a ferrule present between the two elements.

In accordance with the present invention, a shaft tip is inserted into a shaft hole formed in a hosel, a ferrule is partly inserted into the shaft hole whilst embracing the shaft tip, the shaft tip is bonded to the hosel and to the ferrule, and a rugged engagement is arranged between the ferrule and the hosel.

In one preferred embodiment, the rugged engagement includes at least one projection formed on one of the ferrule and the hosel and a corresponding recess formed in the other of the ferrule and the hosel.

In another preferred embodiment, the projection and the recess are both substantially semicircular in transverse cross sectional profile.

In the other preferred embodiment, the projection and the recess are both substantially polygonal in transverse cross sectional profile.

DESCRIPTION OF THE PREFERRED EMBODIMENTS

Figure 1:
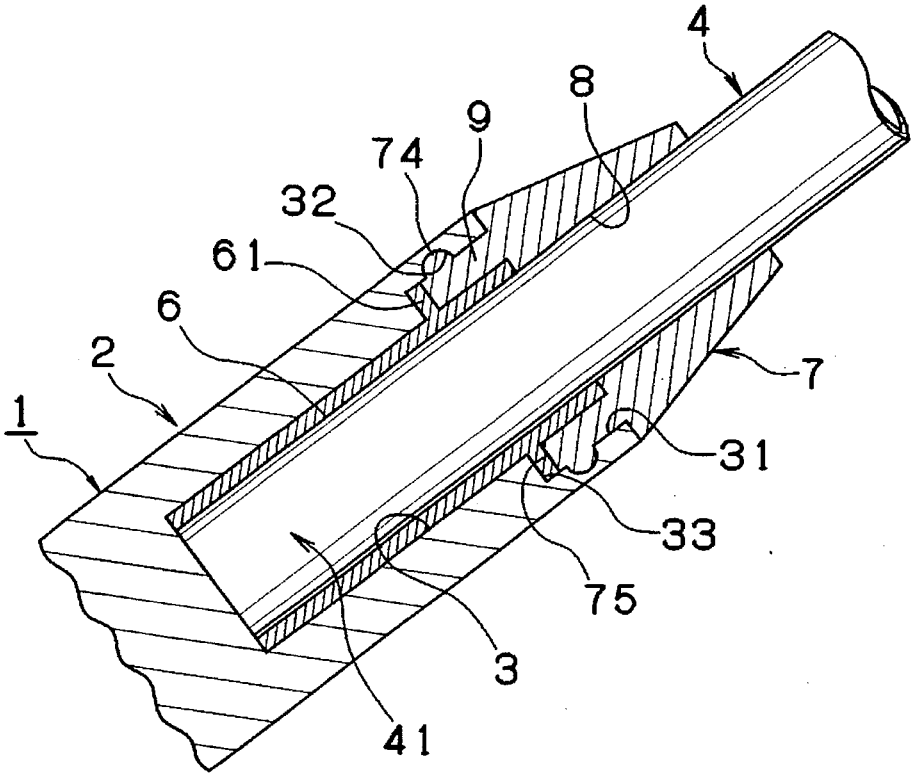
FIG. 1 is a side view, partly in section, of one embodiment of the joint structure in accordance with the present invention.

One embodiment of the joint structure in accordance with the present invention is shown in FIG. 1, in which the joint structure 1 includes, as major elements, a hosel 2, a shaft 4 and a ferrule 7. At least one of the hosel 2 and the ferrule 7 is made of an elastically deformable material such as FRP in order to enable later described snap coupling of the rugged engagement. The hosel 2 is provided with longitudinally extending shaft hole 3 which has an enlarged upper end section 31 of a larger diameter. The shaft 4 has a shaft tip 41 which is inserted into the shaft hole 3 past the upper end section 31. The ferrule 7 is provided with a longitudinal, through hole 71 receptive of the shaft tip 41. The ferrule is monolithic in construction and made up of a conical sleeve section 72 embracing the shaft tip 41 along the entire length of the conical section and a cylindrical barrel section 73 fitted into the upper end section 31 of the shaft hole 3. A bond layer 6 is present between the shaft tip 41 and the barrel section 73 of the ferrule 7. The bond layer 6 has an outer flange 61 sandwiched between the lower end 75 of the ferrule 7 and the inner end 33 of the upper end section 31 of the shaft hole 3.

Figure 2:
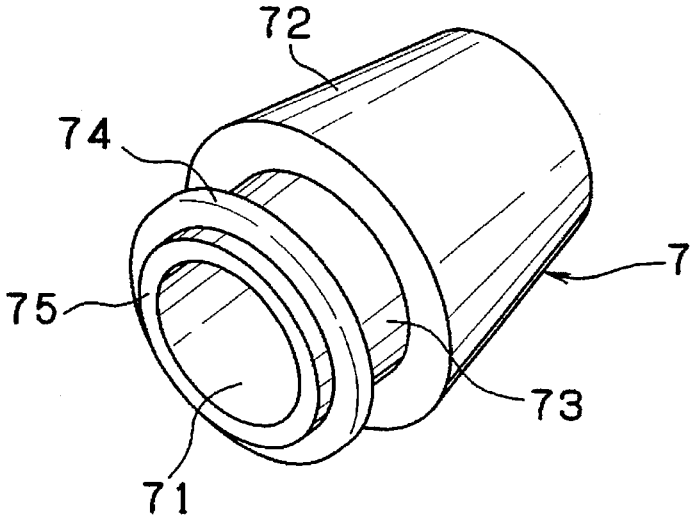
FIG. 2 is a perspective view of one example of the ferrule used for the joint structure shown in FIG. 1.

As stated above, the joint structure in accordance with the present invention is characterized by presence of a rugged engagement arranged between the ferrule 7 and the hosel 2. One example of such a rugged engagement is shown in FIGS. 1 and 2, in which the rugged engagement includes an annular recess 32 formed in the wall of the hosel 2 defining the upper end section 31 of the shaft hole 3 as shown in FIG. 1. The rugged engagement further includes an annular projection 74 formed on the barrel section 73 of the ferrule 7 as shown in FIG. 2.

The position of the annular projection 74 corresponds to that of the annular recess 32 when the ferrule 7 is coupled to the hosel 2. The annular projection 74 and the annular recess 32 are substantially similar in transverse cross sectional profile. In the case of the illustrated example, they have similar semicircular transverse cross sectional profiles.

In assemblage of the golf club, bond is applied to the inner peripheral surface of the shaft hole 3 or to the outer peripheral surface of the shaft tip 41 which is then inserted into the shaft hole 3. Next, the ferrule 7 is moved along the shaft 4 until its barrel section 73 is received in the upper end section 31 of the shaft hole 3. During this insertion, the annular projection 74 on the ferrule 7 snaps into the annular recess 32 in the hosel 2 thanks to elastic natures of the cooperating elements. The initially applied bond now fills gaps between the shaft tip 41 and the hosel 2 as well as gaps between the ferrule 7 and the hosel 2 to form the bond layer 6.

The joint structure thus formed is subjected to repeated shocks at shooting balls. The shock generates a force to push the ferrule 7 upwards along the shaft 4. The force operates in the axial direction on the outer peripheral surface of the barrel section 73 of the ferrule 7. The rugged engagement consisting of the annular projection 74 and the annular recess 32 well withstands the above-described force, thereby effectively deterring the ferrule 4 from moving upwards along the shaft 4. In the case of the conventional joint structure, only the bond layer and frictional resistance between the ferrule 7 and the shaft 4 withstand such a force.

In a preferred embodiment of the present invention, a small gap may be left between the outer peripheral surface of the barrel section 73 of the ferrule 7 and the inner peripheral surface of the upper end section 31 of the shaft hole 3 in order to positively accommodate the bond layer 6. In this case, presence of the above-described rugged engagement enlarges the effective bonding surface between the ferrule 7 and the hosel 2 to further fortify the joint structure.

Figure 3:
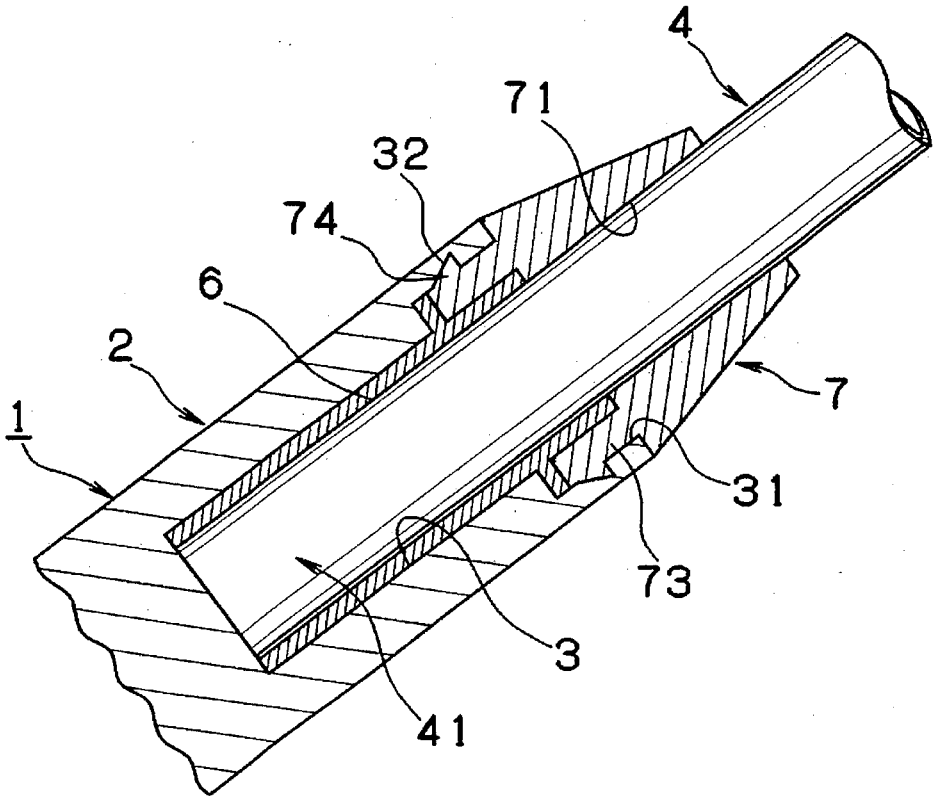
FIG. 3 is a side view of another embodiment of the joint structure in accordance with the present invention.

In the other preferred embodiment of the present invention shown in FIG. 3, the annular projection 74 and the annular recess 32 have similar triangular transverse sectional profiles. Preferably, the triangular profiles diverge upwards. When the above-described upward force acts on the ferrule 7, mating of the ferrule 7 with the hosel 2 in a plane normal to the axial direction of the ferrule 7 well withstands the force.

Figure 4:
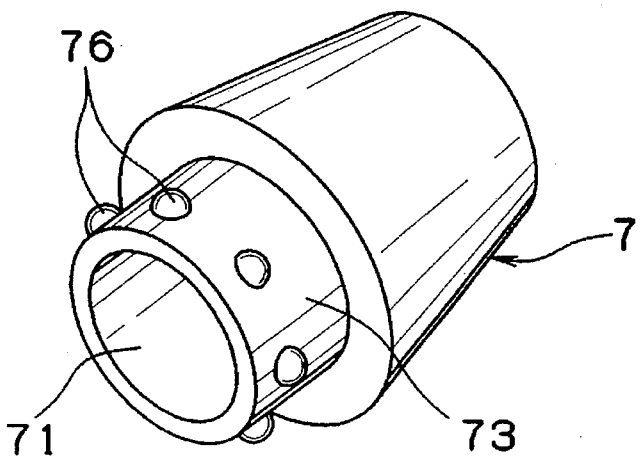
FIG. 4 is a perspective view of another example of the ferrule usable for the joint structure in accordance with the present invention.

As a substitute for the annular projection 74, a number of localized projections 76 may be formed equidistantly in the circumferential direction on the barrel section 73 of the ferrule 7 as shown in FIG. 4. In the illustrated example, the localized projections 76 are hemispherical in configuration. In order to accommodate such localized projections 76, the hosel 2 may be provided with either a circular recess or corresponding number and position of localized recess of a similar configuration. When such a localized rugged engagement is employed, positioning marks are preferably provided on the ferrule 7 and the hosel 2 for correct registration at coupling between the two elements.

When continuous rugged engagement is employed, two or more parallel annular projections and annular recesses may be formed too.

Figure 5:
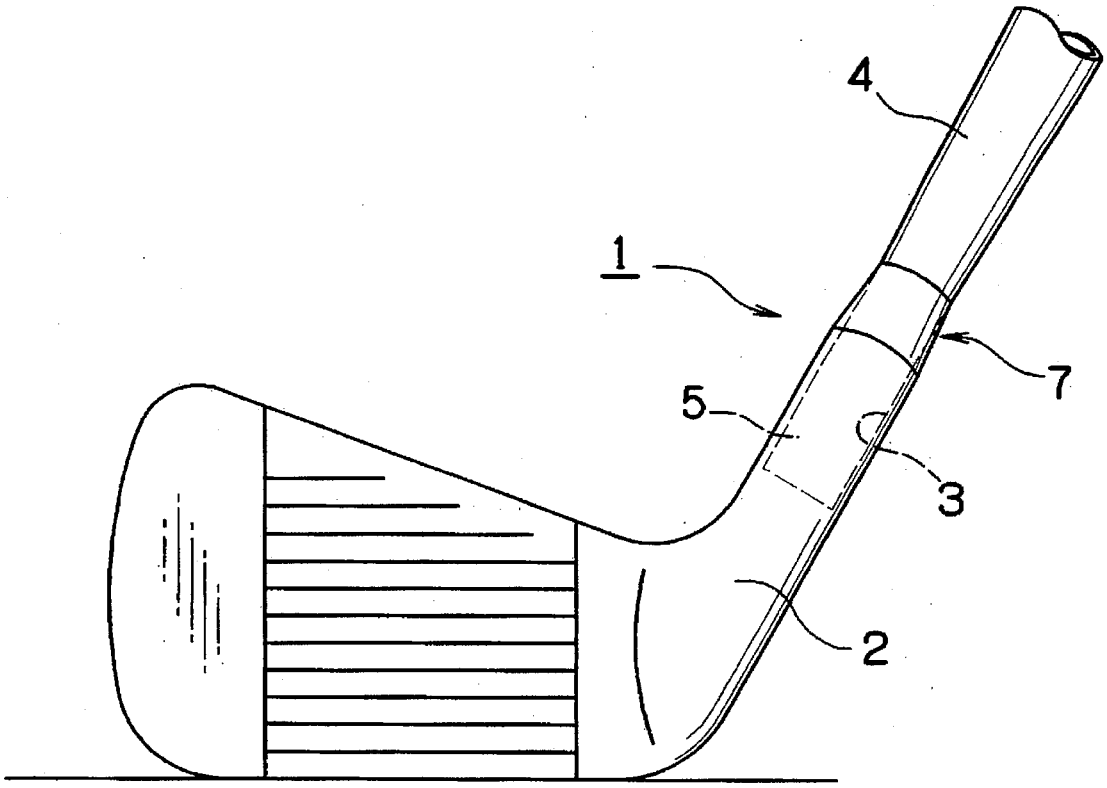
FIG. 5 is a front view of an iron golf club employing the joint structure in accordance with the present invention.

An example of an iron golf club incorporating the joint structure 1 in accordance with the present invention is shown in FIG. 5, not to mention that the concept of the present invention is applicable to other types of golf clubs.

In accordance with the present invention, presence of a rugged engagement in the joint structure well withstands a force which tends to move the ferrule apart from the hosel.

I claim:

1. A joint structure for a golf club comprising a hosel having a longitudinally extending shaft hole having an enlarged upper end section, a shaft tip inserted into said shaft hole in said hosel, a ferrule provided with a through hole receptive of said shaft tip, the ferrule further including a conical sleeve section embracing said shaft tip along the entire extent of said conical section and a cylindrical barrel section fitted into said upper end section of said shaft hole, a bond layer present between said shaft tip and said barrel section of said ferrule, and a rugged engagement arranged between said barrel section of said ferrule and a wall of said hosel defining said upper end section of said shaft hole, said rugged engagement including at least one projection formed on one of said ferrule and said hosel and a corresponding recess formed in the other of said ferrule and said hosel said projection forming a snap-fit with said recess.

2. A joint structure as claimed in claim 1 in which said rugged engagement includes at least one of an annular projection and a corresponding annular recess.

3. A joint structure as claimed in claim 2 in which said annular projection and said annular recess are semicircular in transverse cross sectional profile.

4. A joint structure as claimed in claim 2 in which said annular projection and said annular recess are polygonal in transverse cross sectional profile.

5. A joint structure as claimed in claim 1 in which said rugged engagement includes a plurality of localized projections arranged in the circumferential direction of said ferrule and an annular recess receptive of said localized projections.

6. A joint structure as claimed in claim 1 in which said rugged engagement includes a plurality of localized projections arranged in the circumferential direction of said ferrule and a corresponding number and position of localized recesses.

* * * * *